US006347501B1

(12) United States Patent
Robart

(10) Patent No.: US 6,347,501 B1
(45) **Date of Patent: *Feb. 19, 2002**

(54) PINCHLESS BRIDLE BIT

(76) Inventor: David Robart, 2890 County Rd. 166, Elizabeth, CO (US) 80107

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/092,706

(22) Filed: Jun. 5, 1998

(51) Int. Cl.[7] ..... B68B 1/06
(52) U.S. Cl. ..... 54/8; 54/9
(58) Field of Search ..... 54/7, 8, 9

(56) References Cited

U.S. PATENT DOCUMENTS

| | | | | |
|---|---|---|---|---|
| 103,103 A | | 5/1870 | Swan | |
| 296,815 A | | 4/1884 | Blyhoder et al. | |
| 328,975 A | | 10/1885 | Roberts | |
| 529,472 A | | 11/1894 | Bigelow | |
| 623,333 A | | 4/1899 | Payne | |
| 891,419 A | * | 6/1908 | Herbert | 54/7 |
| 1,091,683 A | * | 3/1914 | Mateer | 54/8 |
| 2,193,451 A | | 3/1940 | Fryer | |
| 2,488,977 A | | 11/1949 | Johnson | 54/7 |
| 2,931,154 A | | 4/1960 | Sauter | |
| 3,205,636 A | * | 9/1965 | Laningham | 54/8 |
| 3,527,023 A | * | 9/1970 | Swanson | 54/8 |
| 3,851,446 A | * | 12/1974 | Bischeltsrieder | 54/8 |
| 4,005,564 A | * | 2/1977 | Simington | 54/8 |
| 5,062,255 A | | 11/1991 | Myler et al. | 54/7 |
| 5,357,735 A | | 10/1994 | Fry | 54/9 |
| 5,822,950 A | * | 10/1998 | De Moya et al. | 54/8 |

OTHER PUBLICATIONS

Dougherty and Lewis (1993) J. Exp. Anal. Behav. 59:521.

* cited by examiner

*Primary Examiner*—Robert P. Swiatek

(57) ABSTRACT

A bridle bit is useful for training an animal, for example, a horse. This bit comprises a bar or bars to be received in the mouth of an animal, the bars having internally disposed therein, one or a plurality of bushings providing mouthpiece rotational movement, and cheek pieces providing traditional rein and headstall ring members for bridle assembly attachment. The invention may be used, for example, for the pinch and/or pain free training, control or correction of horses.

7 Claims, 3 Drawing Sheets

PINCHLESS BRIDLE BIT

RELATED APPLICATIONS

This application is based on the invention disclosure filed under the Document Disclosure Program on Feb. 7, 1998, disclosure document number 431562.

FIELD OF INVENTION

This invention relates to the general fields of animal training and devices therefor. Specifically, the instant application is directed to a novel bridle bit that employs one or a plurality of bushings, said bushings enabling the complete control of separate portions of the bit and preventing pinching or pain inducing stimuli. The present invention, thus, relates to the art of controlling and training bittable animals, for example, horses, through the use of mouth bits, bit assemblies and devices related thereto.

BACKGROUND AND PRIOR ART

Bridle bits and bitting systems have been used all over the world for centuries as a means of communication between the horse and its rider. They are used to communicate to the horse what the rider wishes the horse to do. In fact, horse training is, in large, communication. Without communication between the trainer and trainee, very little, if any, training takes place. Most present day horse training is pressure and pain avoidance training. That is, training via the use of tactile stimuli. Such training is, for example, where pressure is applied and when the horse gives to the pressure, the pressure is released. Thus, use of tactile stimuli has practical application to the control of horse behavior, because horses are controlled by riders through the delivery of tactile stimuli, often called aids by riders. These stimuli are most often given in one of three ways to the horse: to the horses's mouth with the bit, to the sides of the horse with the rider's legs, or to the horses back with the rider's posture or position in the saddle. Thus, there is widespread use of tactile stimuli to control behavior of horses, as it is an effective stimulus for horses. Dougherty and Lewis (1993) J. Exp. Anal. Behav. 59:521.

Commonly used pressure avoidance training may be effected by a leg, a shifting of the rider's weight or the reins and bit. Pain avoidance training is similar. In fact, most currently commercially available bits use this technique—give to the bit and pain is avoided. Some avoidance training is further reinforced using spurs, crops or whips. This type of training works, but it limits the communication between the horse and trainer by causing stress to both parties. Stress lowers the learning ability of all human and non-human animals. Specifically, when a horse is scared of making a mistake it is avoiding correction. That is, avoiding pain. This takes energy and keeps the horse in a defensive mode or posture. Horses are flight-oriented animals and are strong. Attempts at training are ineffective if the horse is not calm enough to receive the training stimuli. That is, listen to what is being communicated.

Bridle bits are generally used by the rider as a means of control or correction. Therefore, a horse is corrected for undesirable behavior but receives nothing for correct behavior. This methodology limits the trainer to pressure and pain avoidance training. That is, using punishment and correction for what is generally called aversive stimulation training. With the use of only corrections for undesirable behavior, the horse is caused higher levels of stress and prevented from reaching its full potential of learning ability. Horses' bits, a primary source of aversive stimulation, are carefully designed to allow the delivery of a punishing stimulus to the horse in a sensitive area with little effort by the rider. This is accomplished by a system of leather straps that hold the bit in the horse's mouth—collectively, called the bridle. By putting pressure on the reins attached to the bit, the rider brings the bit to bear on the horse's jaw bones. At rest, the bit sits on the horse's jaw bone, fitting comfortably into natural spaces between the horse's teeth. These very sensitive bones are easily stimulated by putting tension on the reins attached to the bit. Thus, the horse's behavior is readily reinforced by escape and avoidance of this punishing, or aversive, stimuli.

An understanding of the conditioning processes involved in training horses is lost because of two confusing factors. One is that the reins, through their attachment to the bit, are used to deliver both non-aversive and aversive stimuli. The other factor, horses' behavior problems can arise from a training regimen that fails to employ appropriate conditioning techniques or employs techniques that give the horse mixed messages. On the other hand, positive reinforcement training assists a horse in being motivated and enthusiastic in learning. This approach, in turn, lowers stress and decreases errors. Using only corrections causes higher stress in the horse and prevents the use of the horse's full learning and performance potential.

No satisfactory solution to the problem of limiting a horses learning ability through pressure and pain avoidance training has been provided thus far. Current bridle bit technology has enabled numerous variations on a theme to be commercially marketed. That is, various bit configurations that are all based on pain avoidance and negative reinforcement. The prior art discloses several different types of horse bits having bushings and/or rotatable parts. U.S. Pat. No. 103,103 to Swan, describes a pressure producing bridle bit having bars joined together in the center by a swivel-joint that consists of a barrel and a cylindrical nut allowing adjustment of either side of the bar against the corner of a horse's mouth.

U.S. Pat. 623,333 to Payne, discloses an improved bridle bit. Said bit is useful for avoiding chafing or irritation to a horse's mouth by allowing the free lateral movement of the rein-bar while the tubular mouthpiece's position remains unchanged.

Blyhoder and Hughes, U.S. Pat. 296,815, describe a hollow or tubular, T-shaped bridle bit with rings on either end thereof. Said bit is intended for preventing the adverse habit of wind-sucking.

A bridle bit having a mouthpiece with a centrally depressed portion provided with a covering or ball which is rotatably pressed against the roof of the horses mouth in use is disclosed in U.S. Pat. No. 529,472 to Bigelow.

Next, U.S. Pat. No. 1,091,683 to Mateer, describes a discloses an improved bridle bit having a medicine cup interposed between outer bar sections of the mouthpiece, said medicine cup engaged via swivel joint. Said bit is useful for the administration of medicine and aversive training.

Fryer, U.S. Pat. No. 2,193,451, discloses a loose jaw curb bit having adjustable cheek piece movement limitations. That is to say, having cheek pieces that are moveably connected to the mouthpiece via an adjustable universal ball and joint connection.

The curb-type bridle bit disclosed in U.S. Pat. No. 2,488,977 to Johnson comprises a conventional curb bit providing the ability to rock the bit in the horse's mouth via a bearing means disposed at either lateral end of the bar, between said bar and cheek pieces.

Sauter, U.S. Pat. No. 2,931,154, teaches an animal controlling apparatus that may be substituted for a bridle bit, which apparatus is use useful for animal control with a minimum of discomfort thereto.

A snaffle bit comprising a pari of bar parts joined by an elastic hinge is disclosed in U.S. Pat. No. 3,851,446 to Bischeltsrieder. The object of said bit it to provide a single bit having variable widths.

U.S. Pat. No. 4,005,564 to Simington teaches a bit having bar arms pivotally connected, via ball and socket joints, to a center coupling pacifier for eliminating objectionable mannerisms, e.g., tongue protruding, teeth grinding, and lip smacking.

Fry, U.S. Pat. No. 5,357,735, discloses an adjustable horse bit, the object of which is to provide a bit having the capability to adjust to various widths in order to accommodate different sized horse mouths.

U.S. Pat. No. 5,062,255 to Myler et al. discloses a bridle bit having a mouthpiece with independently movable cheek pieces at each end and rotatable head stall and rein ring connections fore and aft of the cheek pieces.

None of the currently commercially available bridle bits enable the rider or driver to independently work portions of the bridle bit without pinching, or causing irritation, to the horse's mouth. The present invention overcomes this prior art shortcomings by allowing the user independently manipulate the bar or bars and/or the cheek pieces of the bit without employing conventional pain avoidance techniques. That is, the instant invention is pinchless by virtue of its construction including one or more internally disposed bushings providing rotational movement without pinching the horse's tongue. While prior art devices are suitable for pure control via pressure and pain avoidance, they cannot be efficiently and effectively used for pinchless animal training in that they twist, swivel, or the like. The present invention, however, provides improved bridle bits that enable the rider or driver to correct an animal in a pinch free manner. The invention described herein is made from any or all of the currently available substances and variations generally used with bits and bridles. The current invention, thus, provides for novel bridle bits for controlling or training a horse without causing injury, pain or stress to the horse. Therefore, apparatuses made according to the present invention are completely safe and effective for their intended use.

An object of the present invention is to provide a bit having one or more points of rotation for bar and/or cheek piece maneuverability without producing the pinching or pain producing action of currently available bits.

Another object of the present invention is to provide bars having the ability to rotate from 0–360 degrees, or alternatively, further comprise a limiter that enables the adjustment and limitation of degrees of rotation.

An additional object of the invention is to provide a bit that is allowed under nationally recognized horse show rules, e.g., American Horse Show Association, in the show ring.

Yet another object of the present invention is to provide a humane training aid.

Additionally, the present invention provides bridle bits that achieve the above disclosed objectives and yet are be easily applied to and used on a horse without any special skills or training of the rider or driver.

SUMMARY OF THE INVENTION

This invention is based on a novel concept for improved bridle bits-bits having the specific rotatable bushing disclosed herein or other rotatable couplers internally disposed within the bar or bars of the bit. The invention relies on the principals of behavior modification psychology and general animal training in that pain avoidance training is obviated by its use. The present invention is defined by a bar or bars, one or more internally disposed rotatable couplers, i.e., bushings, a plurality of cheek pieces functionally attached to said bar or bars and having ring members mounted thereon.

The present invention is an improved bridle bit that permits the control and/or correction of a horse without inflicting pain, thereby reducing stress and increasing learning potential. The present invention is applicable to all styles of bits, bit assemblies and derivatives thereof Furthermore, it is suitable for the training of all non-human animals capable of accepting a bit. The present invention is useful for training and long term control and/or correction of non-human animals, i.e., horses, but is not intended to be limited to these uses.

In the preferred embodiment of the invention, a pinchless snaffle configuration is disclosed, wherein, within each half of the mouthpiece an internal bushing is disposed laterally between the body of the bar and the standard central snaffle ring. When the rider or driver engages either one of both of the reins, the two halves of the mouthpiece rotate independent of one another without producing the pinching action of conventional snaffles.

Alternative embodiments of the instant invention include integration of various conventional bit configurations with the novel internal rotatable coupler (bushing) disclosed herein. More specifically, bit configurations known in the art include, for example, O-, D-, and full cheek ringed snaffles, hidden mullen barrels, hinged snaffles, french link snaffies, twists, life savers, ported and unported curbs, straight bars, and half-breed correctional bits.

The instant invention provides the rider or driver an alternative means of communication with the animal being trained—as opposed to traditionally used control and pain avoidance techniques. Other features and advantages of the present invention will become apparent from the following detailed description, taken in conjunction with the accompanying figures, that illustrate by way of example, the principles of the instant invention.

Figure 1:
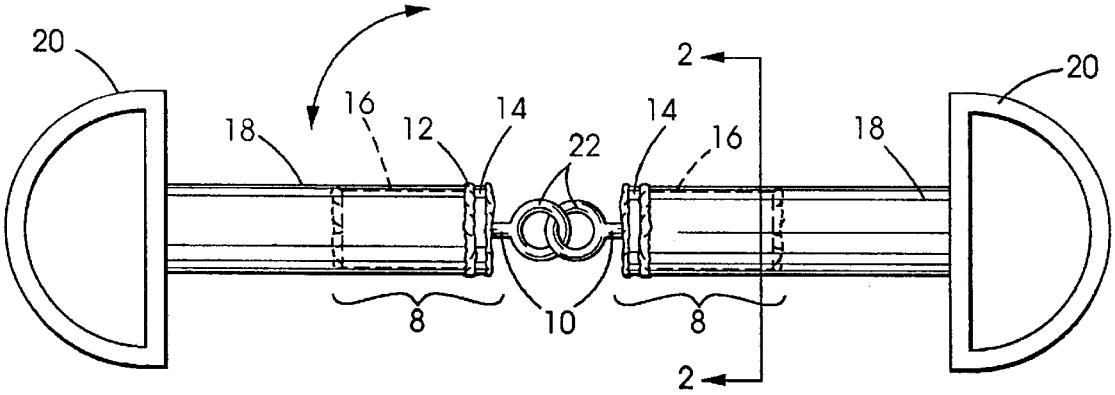
FIG. 1 is a perspective view of the bit mouth piece of the preferred embodiment of the present invention.

| REFERENCE NUMERALS IN FIGURES | |
|---|---|
| 8 | bushing |
| 10 | shaft |
| 12 | shaft sleeve |
| 14 | internal sleeve ring |
| 16 | bushing sleeve |
| 18 | bar |
| 20 | D-ring member |
| 22 | center O-ring |
| 24 | shank ring member |
| 26 | O-ring member |
| 28 | limiter |
| 30 | hinge |
| 32 | french link |
| 34 | barrel |
| 36 | roller |
| 38 | plate |

DETAILED DESCRIPTION OF THE PREFERRED EMBODIMENT

It is to be understood that both the foregoing general description and the following detailed description are exemplary and explanatory only and are not restrictive of the invention as claimed.

The following definitions are helpful in understanding the specification and claims. The definitions provided herein should be borne in mind when these terms are used in the following examples and throughout the instant application.

As used herein, the term "mouthpiece" refers to the portion of a bit assembly adapted for being received in the mouth of an animal. Generally, in conventional bit configurations, the mouthpiece is comprised of one or more portions called bars. Bars may be solid or hollow, constructed of any number of materials, for example, nickel, rubber, silver, and may or may not have apertures therethrough for adaption to positive reinforcement training systems. Further, a plethora of conventional bit configuration include additional elements mounted between the bars, for example, one or more O-ring, french links, rollers, and barrels. Each of these elements is an aid for achieving a specific object of the bit configuration. For example, rollers are generally used to calm nervous horses.

As used in this invention, the term "cheek pieces" refers to the portion of a bit assembly laterally located and mounted on either end of the mouthpiece. The cheek pieces may be configured, for example, in ring member style, loose or fixed, or may be configured in a shank style, rotatable or fixed. Any of known standard cheek piece configurations is adaptable for use with the instant invention.

The term "bushing" , as used herein refers to the novel, internally disposed, rotatable bushing/coupler device. "Internally disposed" means that the bushing device is contained within the bar of the bridle bit; only a smooth rotation seam is perceivable by either tactile or visible sensation. A "limiter" is an additional element, for example, a split O-ring, added to the bushing construction that limits the rotational movement of the coupler device.

The present invention provides a bridle bit for the control and correction necessary for behavior modification training of, for example, horses. It is recognized by those skilled in the art that a broad range of training methodologies and alternative uses of the bit may be performed in accordance with the present invention. Uses may include alternative training techniques, alternative bit configurations, alternative use with any animal capable of accepting a bit, or any number of other uses not explicitly discussed herein. Generally, the present invention is useful for pinch and/or pain free bit communication between a rider or driver and a trainee animal.

In its broadest embodiment, the pinchless bit comprises a bitting mouth piece or pieces, cheek pieces having rein and head stall connection means, e.g., O-rings, D rings, or shanks. Said mouth pieces may be solid or hollow for any number of purposes, for example, weighting, and have internally disposed bushing or bushings coupling rotatable mouthpiece sections together. Said mouthpiece section may be coupled centrally with a single bushing, or alternatively, coupling may employ a plurality of bushings internally disposed on the bar or bars of the mouthpiece on one or more points located laterally between the cheek pieces. Said bushings providing an internal means of rotational movement to the mouthpiece.

Figure 2:
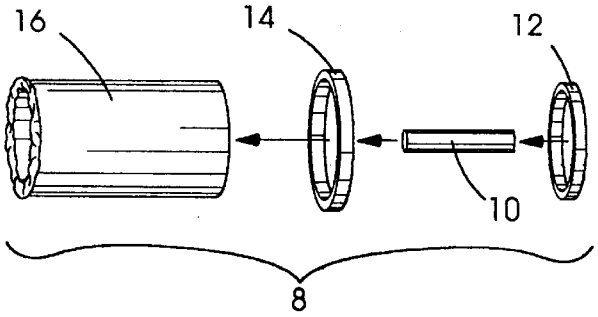
FIG. 2 is an exploded view of the portion indicated by the section line 2—2 in FIG. 1, illustrating the inner shaft and sleeves comprising the internal rotatable coupler (bushing) disposed within the mouth bar or bars.

The preferred embodiment of the device disclosed herein, a pinchless snaffle, as shown in FIG. 1, has two internally disposed bushings as shown in FIG. 2. A solid mouthpiece bar 18 couples to the bushing sleeve 16. Within the bushing sleeve 16 is contained an internal sleeve ring 14 that prevents a shaft sleeve 12 from continuing through the bushing device 8 itself, thus, acting as a block. The shaft sleeve 12 is mounted or joined to a shaft 10, preferably metal, that passes through the internal sleeve ring 14 and extends out through the bushing sleeve 16, connecting to, via for example, welding, a center snaffle O-ring 22. Opposite the end of mouthpiece bar 18 having a bushing 8 mounted therein, the bar 18 connects to a ring member, for example, a D-ring member 20, to which is accordingly attached the reins and head stall of a bridle assembly.

In use, when properly assembled with reins and a head stall, the mouthpiece bars 18 function independently of each other. That is to say, when the rider or trainer engages a rein, for example, the left rein, the corresponding left-half of the bit responds by rotating in an amount in direct proportion to the amount of engagement by the rider or trainer.

Figure 3:
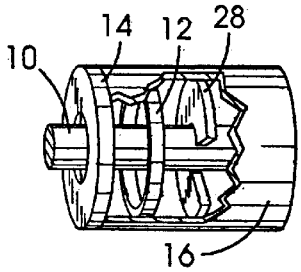
FIG. 3 depicts an alternate embodiment of the novel bushing further comprising a limiter such that the movement of the bushing is restricted from 360 degrees to less than one full rotation.

FIG. 2 depicts the preferred embodiment of bushing device disclosed herein, however, numerous bushing variations are both envisioned and possible, provided they are adaptable to internal bar mounting. In general, the bushing is constructed and/or joined to the remainder of the bit assembly by welding. An alternate embodiment of the novel bushing disclosed herein is seen in FIG. 3. This embodiment is identical to the previously discussed bushing and further comprises a limiter 28. That is, an additional piece of construction, for example, a split sleeve ring that limits the rotational movement of the bushing to less than one full rotation of 360 degrees.

Figure 4:
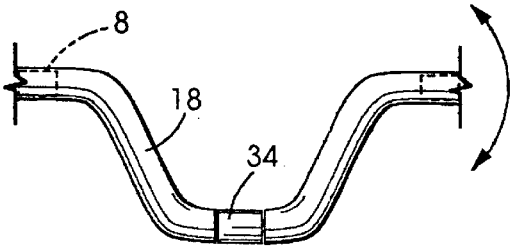
FIG. 4 illustrates an alternate embodiment of the present invention integrating a standard hidden mullen bit configuration with the novel bushing aspects of the instant invention.

FIGS. 4–14 illustrate alternative embodiments of the bushing:bit configuration integration. As shown in FIG. 4, a hidden mullen barrel configuration of bit is adapted to use with the instant bushing invention. Located at the center of a split bar 18 is a mullen barrel 34; coupled to the bar laterally in both directions, located between the bit's port and the cheek pieces, are a plurality of internally disposed bushings 8.

Figure 5:
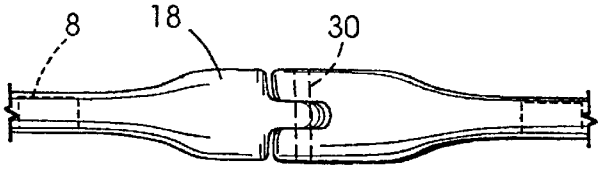
FIG. 5 illustrates an alternate embodiment of the present invention integrating a standard hinged snaffle bit configuration with the novel bushing aspects of the instant invention.
Figure 6:
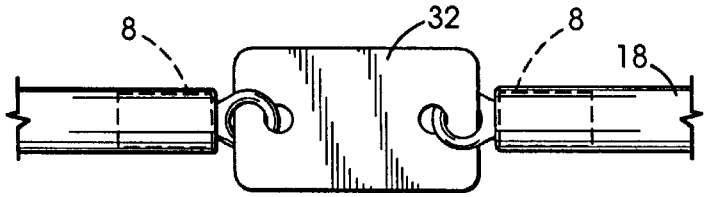
FIG. 6 illustrates an alternate embodiment of the present invention integrating a standard french link snaffle bit configuration with the novel bushing aspects of the instant invention.

A conventional hinged snaffle bit configuration integrating the bushing 8 is seen in FIG. 5. Here, located at the center of a split bar 18 is a snaffle hinge 30 to which, laterally in each direction, is disposed an internal bushing 8 within the bar of the bit. In similar fashion, a french link configuration integrates the same features. See, FIG. 6. A french link is especially adaptable for use with the embodiment comprising a bushing and a limiter, based on the standard use of such a bit.

Figure 7:
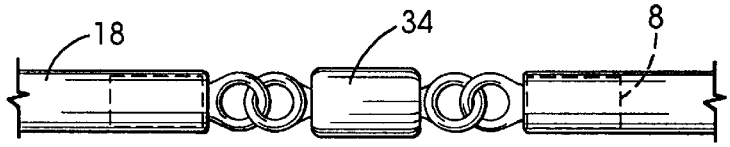
FIG. 7 illustrates an alternate embodiment of the present invention integrating a standard snaffle barrel bit configuration with the novel bushing aspects of the instant invention.
Figure 8:
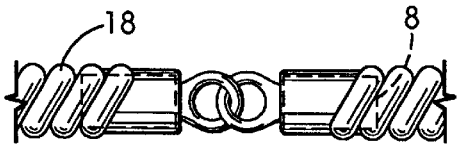
FIG. 8 illustrates an alternate embodiment of the present invention integrating a standard wire twist bit configuration with the novel bushing aspects of the instant invention.
Figure 9:
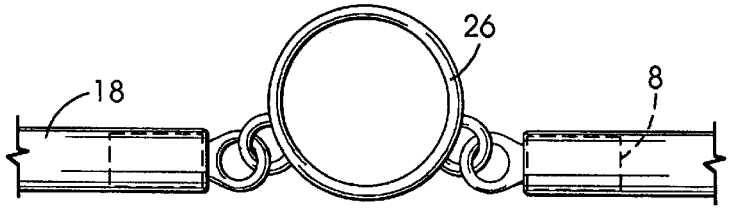
FIG. 9 illustrates an alternate embodiment of the present invention integrating a standard O-ring snaffle bit configuration with the novel bushing aspects of the instant invention.
Figure 10:
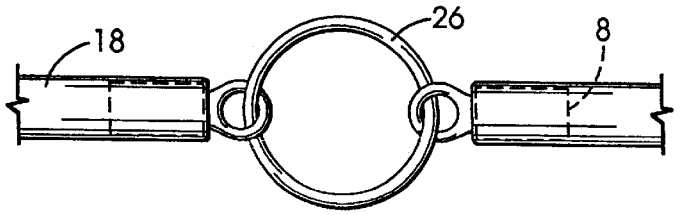
FIG. 10 illustrates an alternate embodiment of the present invention integrating a standard life saver bit configuration with the novel bushing aspects of the instant invention.

FIG. 7, a snaffle barrel 34, is adapted to use with both the standard bushing and/or the bushing plus limiter, disclosed herein.

FIGS. 8–10 and 13 depict the integration of bushings and standard wire twist, O-ring snaffle and life saver bits, wherein the central feature of the bit is flanked on either side by a bushing 8. The life saver bit is particularly adaptable for use with a limiting bushing.

Figure 11:
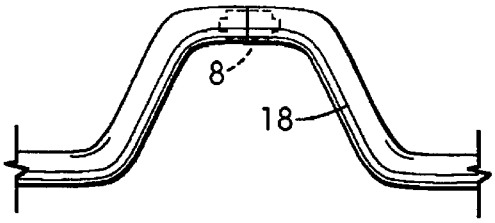
FIG. 11 illustrates an alternate embodiment of the present invention integrating a standard ported curb bit configuration with the novel bushing aspects of the instant invention.
Figure 12:
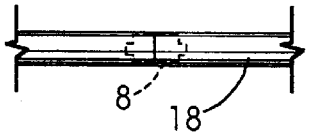
FIG. 12 illustrates an alternate embodiment of the present invention integrating a standard straight curb bit configuration with the novel bushing aspects of the instant invention.
Figure 13:
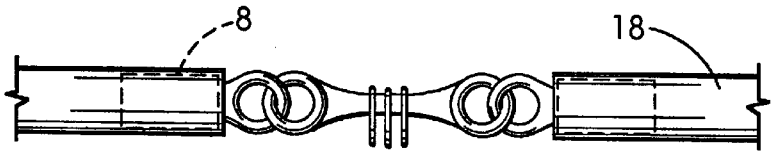
FIG. 13 illustrates an alternate embodiment of the present invention integrating a standard snaffle with O-rings bit configuration with the novel bushing aspects of the instant invention.

FIGS. 11 and 12 show the integration of the bushing 8 into the center of a low, medium or high port bar 18 by splitting the bar. Thus, in a high port bit for use with tongue sensitive horses, for example, the port functions as in a conventional bit configuration, however, the rider or driver may independently work either half of a bit that, heretofore, always functioned as a whole.

Figure 14:
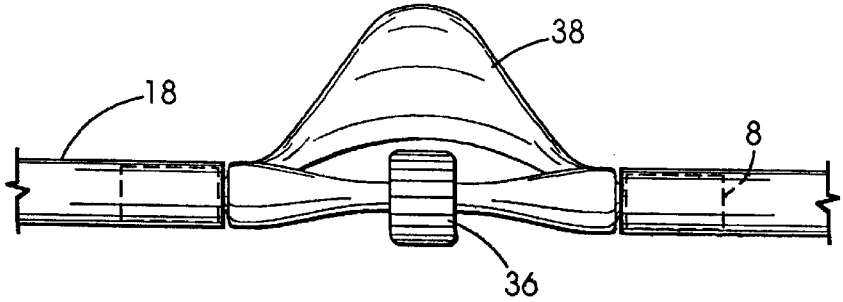
FIG. 14 illustrates an alternate embodiment of the present invention integrating a standard half-breed correctional bit configuration with the novel bushing aspects of the instant invention.

FIG. 14, a half breed correctional bit is particularly adaptable for use with limiter bushing 8. By flanking the center roller 36 and plate 38 portion of the bit with limiter bushings 8 in the bar, the engagement of the bit makes the chain of the bridle assembly hit the chin of the horse first. If the horse does not respond to the command, the rider or driver "picks up" the rein and the plate engages the hard palate of the animal.

The method and apparatus disclosed herein provides for a training and behavior modification bridle bit assembly. Further, this device significantly reduces stresses placed on the horse in training, while improving the performance and learning potential of same.

While the above description contains many specificities, these should not be construed as limitations on the scope of the invention, but rather an exemplification of the preferred embodiment thereof. Many other variations are possible. Thus, the scope of the invention should be determined by the appended claims and their legal equivalents, rather than by the examples given.

I claim:

1. A bridle bit comprising:

a mouthpiece, said mouthpiece comprising one or a plurality of bars adapted to be received in the mouth of an animal and having laterally extending ends;

one or a plurality of rotatable bushings designed to ratate and capable of complete rotation internally disposed within said mouthpiece; and a plurality of cheekpieces mounted to the laterally extending ends of said bar or bars.

2. A bridle bit as defined in claim 1 wherein said at least one rotatable bushing further comprises a limiter portion thereby limiting rotation of said at least one bushing to less than 360 degrees.

3. A bridle bit as defined in claim 2 wherein said mouthpiece further comprises one or a plurality of bitting elements disposed and mounted between the plurality of cheekpieces.

4. A bridle bit as defined in claim 1 wherein said mouthpiece further comprises one or a plurality of bitting elements disposed and mounted between the plurality of cheekpieces.

5. A bridle bit as defined in claim 4 or 3 wherein said bitting element or elements is selected from a group consisting of ring, link, cricket, roller and joint.

6. A bridle bit as defined in claim 1, wherein said cheekpiece or cheekpieces are rotatably mounted to the laterally extending ends of said bar or bars.

7. A bridle bit as defined in claim 1, wherein said cheekpiece or cheekpieces are fixedly mounted to the laterally extending ends of said bar or bars.

* * * * *